US006945200B2

(12) United States Patent
Bergström et al.

(10) Patent No.: US 6,945,200 B2
(45) Date of Patent: Sep. 20, 2005

(54) COOLING SYSTEM FOR A VEHICLE AND A VEHICLE COMPRISING THE COOLING SYSTEM

(75) Inventors: Magnus Bergström, Eskilstuna (SE); Frederik Grop, Eskilstuna (SE); Pontus Evertsson, Eskilstuna (SE)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 10/906,943

(22) Filed: Mar. 14, 2005

(65) Prior Publication Data

US 2005/0139176 A1 Jun. 30, 2005

Related U.S. Application Data

(63) Continuation of application No. PCT/SE2003/001158, filed on Jul. 2, 2003.

(30) Foreign Application Priority Data

Sep. 13, 2002 (SE) ..... 0202724

(51) Int. Cl.[7] ..... F01P 1/06
(52) U.S. Cl. ..... 123/41.31; 123/41.29
(58) Field of Search ..... 123/41.31, 41.33, 123/41.29, 41.1

(56) References Cited

U.S. PATENT DOCUMENTS

| | | | | |
|---|---|---|---|---|
| 5,201,285 | A * | 4/1993 | McTaggart | 123/41.31 |
| 5,669,338 | A | 9/1997 | Pribble et al. | |
| 5,730,089 | A * | 3/1998 | Morikawa et al. | 123/41.33 |
| 6,457,442 | B1 * | 10/2002 | Fuchs et al. | 123/41.29 |

* cited by examiner

*Primary Examiner*—Noah P. Kamen
(74) *Attorney, Agent, or Firm*—White, Redway & Brown LLP

(57) ABSTRACT

A cooling system for a vehicle includes a first cooling circuit coupled to the vehicle engine for cooling the latter and a pump arranged in the first cooling circuit for pumping a coolant to the engine. The system further includes a second cooling circuit for cooling at least one other component in the vehicle, and an arrangement for coupling the second cooling circuit into the first cooling circuit in order to also supply the second cooling circuit with coolant from the pump. The cooling system further includes a line coupled from the first cooling circuit to the second cooling circuit bypassing the coupling means so that the second cooling circuit is supplied with coolant from the pump via the bypass line even when the coupling means is set to the disconnected position.

20 Claims, 2 Drawing Sheets

COOLING SYSTEM FOR A VEHICLE AND A VEHICLE COMPRISING THE COOLING SYSTEM

This application is a continuation of PCT/SE2003/001158, filed Jul. 2, 2003, and claims priority to SE 0202724-1, filed Sep. 13, 2002, both of which are incorporated by reference.

BACKGROUND AND SUMMARY

The present invention relates to a cooling system for a vehicle, the system comprising a first cooling circuit coupled to the vehicle engine for cooling the latter, a pump arranged in the first cooling circuit for pumping a coolant to the engine, a second cooling circuit for cooling at least one other component in the vehicle, and means of coupling the second cooling circuit into the first cooling circuit in order to also supply the second cooling circuit with coolant from the pump.

Such a cooling system may be used, for example, in a work vehicle, such as a wheel loader, which comprises hydraulic components in the form of working cylinders, for example, for maneuvering/moving an implement. With regard to the hydraulics, it is primarily the hydraulic oil and gaskets, seals, etc. which are temperature sensitive.

According to a previously known system the coupling means consists of a thermostat, which is operatively controlled by the engine temperature to cut in automatically when the engine temperature exceeds a certain value.

According to this previously known system just one pump is used to provide cooling both for the vehicle engine and for the hydraulic components of the vehicle. One problem with this system is that under certain conditions the thermostat will not cut in, with the result that the hydraulic components do not receive the necessary cooling. One example of this occurs in an extremely cold climate when the vehicle is used in such a way that its hydraulic components become so hot that cooling is required, whilst the engine is not hot enough for the thermostat to cut in.

The cooling system may furthermore be designed to cool transmission components in the form of gears and shafts in the vehicle axle housings, for example, via the second cooling circuit. A problem with this system is that under certain operating conditions the thermostat will not cut in, with the result that the transmission components do not receive the necessary cooling. An example of this is in so-called leveling, when a mass of earth is pushed ahead of the vehicle. In this application the transmission becomes hot, whilst the engine is cold.

A further problem with the previously known system is that if the thermostat fails and does not or is not open, there is no cooling at all of the hydraulic or transmission components.

The temperature limit at which the thermostat cuts in is controlled by the engine exhaust. Owing to the ever more stringent requirements governing vehicle exhaust emissions, this temperature limit is also increasing. It is therefore not just simply a matter of adjusting the temperature limit for a specific vehicle to a lower value in order to also provide the second circuit with coolant.

The invention will be described below in its application to a work vehicle in the form of a wheel loader. This is to be regarded as a preferred application but is in no way limitative. The invention can be realized, for example in other types of work vehicle, such as a dumper truck or excavator-loader, for example. The invention is furthermore not confined to work vehicles, but could also be applied to other types of vehicle, such as industrial trucks.

The term disconnected position signifies that the coupling means is not set to connect the first and second circuits.

In accordance with an aspect of the present invention, a cooling system for a vehicle comprises a first cooling circuit coupled to the vehicle engine for cooling the engine, a pump arranged in the first cooling circuit for pumping a coolant to the engine, a second cooling circuit for cooling at least one other component in the vehicle, means for coupling the second cooling circuit into the first cooling circuit in order to also supply the second cooling circuit with coolant from the pump when the coupling means is in a connected position, and a bypass line coupled from the first cooling circuit to the second cooling circuit bypassing the coupling means, so that the second cooling circuit is supplied with coolant from the pump via the bypass line even when the coupling means is in a disconnected position.

In accordance with another aspect of the present invention, a cooling system for a vehicle comprises a first cooling circuit coupled to the vehicle engine for cooling the engine, a pump arranged in the first cooling circuit for pumping a coolant to the engine, a second cooling circuit for cooling at least one other component in the vehicle, a thermostat for coupling the second cooling circuit into the first cooling circuit in order to also supply the second cooling circuit with coolant from the pump when the coupling means is in a connected position, and a bypass line coupled from the first cooling circuit to the second cooling circuit bypassing the thermostat, so that the second cooling circuit is supplied with coolant from the pump via the bypass line even when the thermostat is in a disconnected position.

In accordance with a further aspect of the present invention, a vehicle comprises a cooling system of the type described above.

BRIEF DESCRIPTION OF THE DRAWINGS

The invention will be described in more detail below with reference to the embodiment shown in the drawings attached, in which.

DETAILED DESCRIPTION

Figure 1:
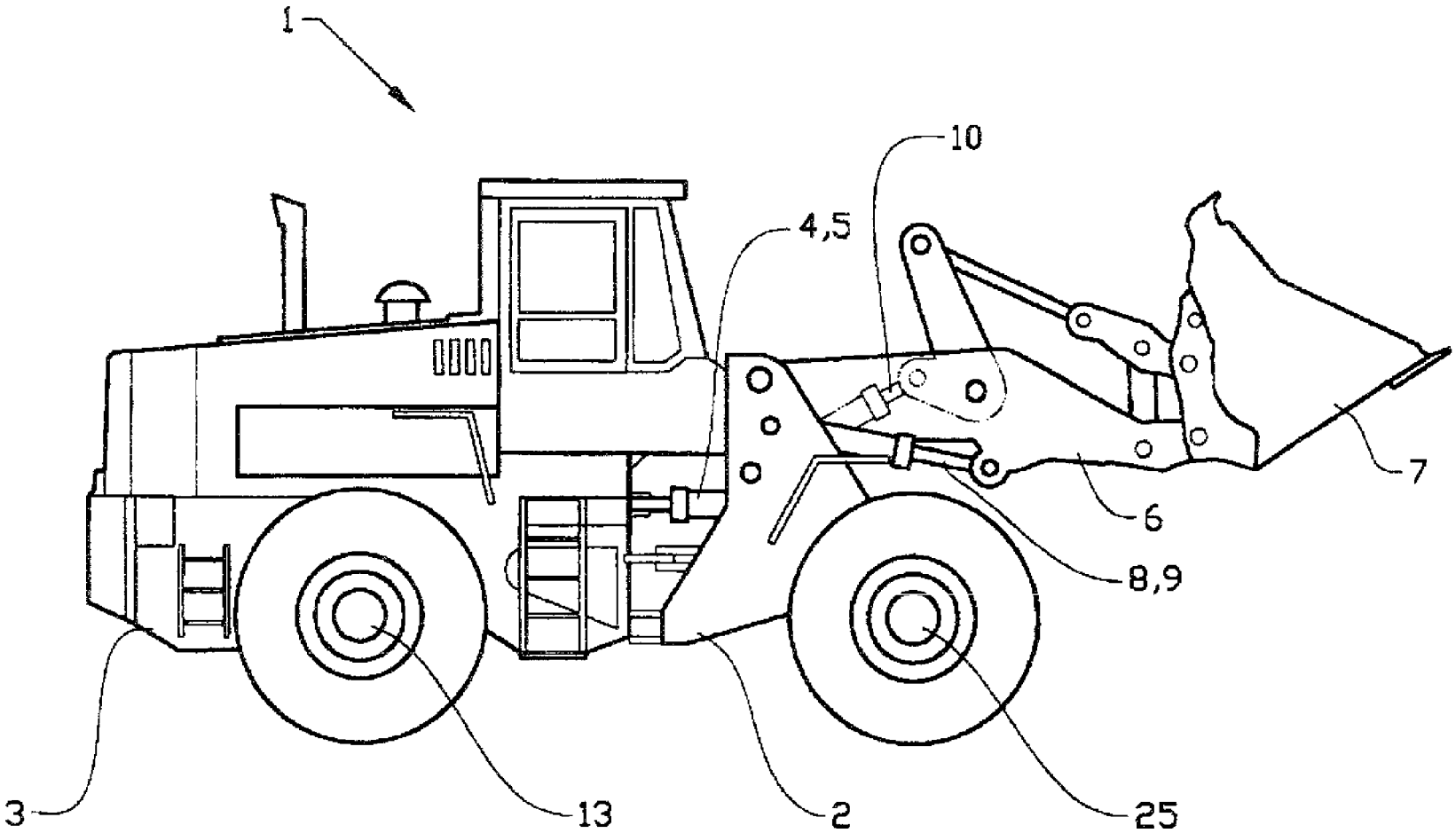
FIG. 1 shows a side view of a wheel loader.

FIG. 1 shows a wheel loader 1. The body of the wheel loader 1 comprises a front body part 2 and a rear body part 3, these parts being joined to one another by an articulated connection. The body parts 2,3 can be rotated in relation to one another about an articulated joint by means of two hydraulic components in the form of working cylinders 4,5 arranged between the two parts.

The working cylinders 4,5 are therefore designed for turning the wheel loader 1.

The wheel loader 1 furthermore has a load unit 6 and an implement in the form of a shovel 7 arranged on the load unit. The load unit 6 can be raised and lowered in relation to the front part 2 of the vehicle by means of two hydraulic components in the form of two working cylinders 8,9, each of which is connected at one end to the front part of the vehicle 2 and at its other end to the load unit 6. The shovel 7 can be tilted in relation to the load unit 6 by means of a further hydraulic component in the form of a working cylinder 10, which is connected by one end to the front part of the vehicle 2 and by its other end to the shovel 7.

Figure 2:
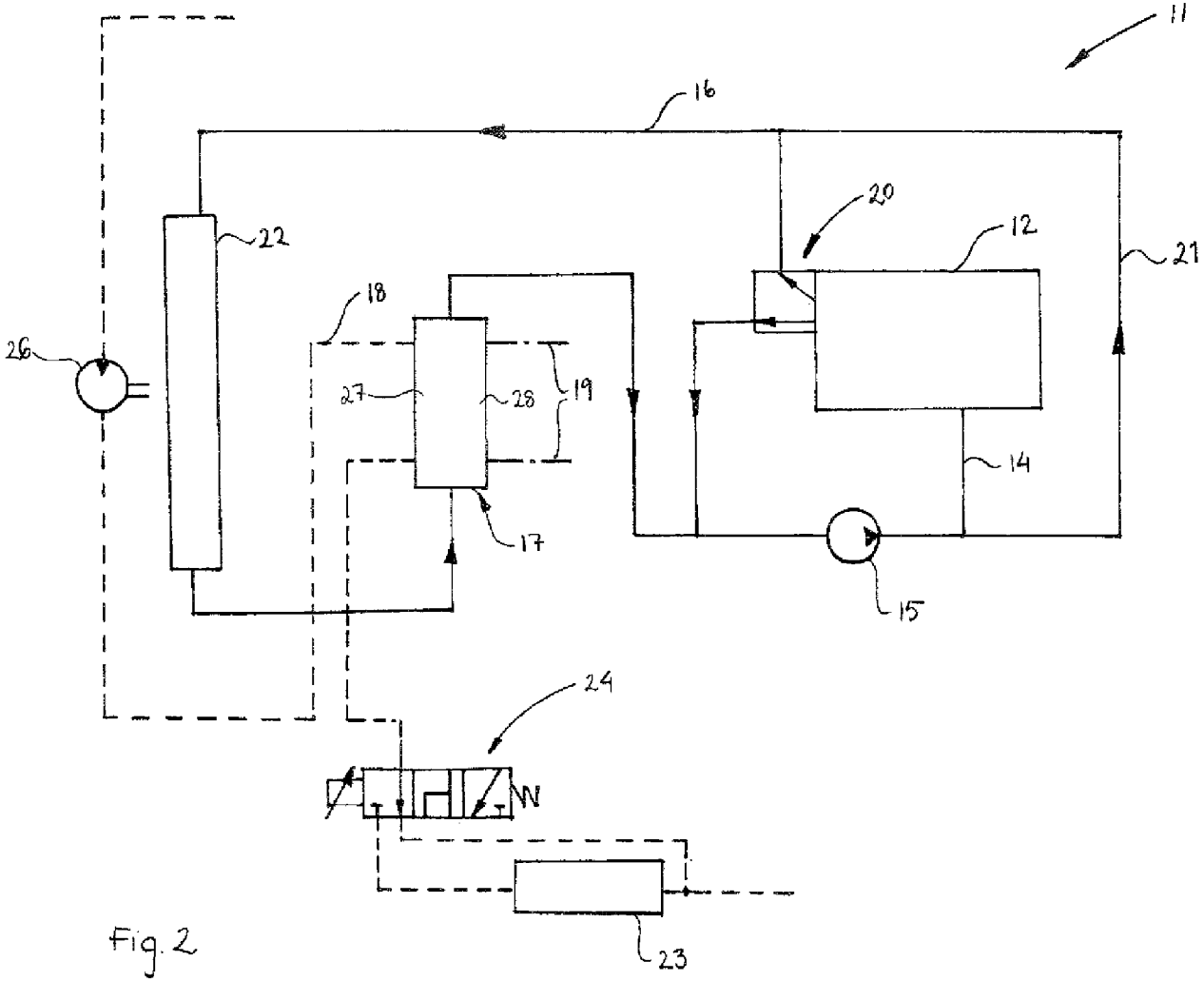
FIG. 2 shows a schematic diagram of the cooling system according to the invention.

FIG. 2 shows a schematic diagram of a cooling system 11 for the wheel loader 1. The wheel loader 1 has an engine 12, which is designed to drive at least one rear drive axle 13. The engine 12 comprises an internal combustion engine in the form of a diesel engine.

The cooling system 11 comprises a first cooling circuit 14 coupled to the vehicle engine 12 for cooling the latter. The first cooling circuit 14 here comprises a type of internal circuit in the engine. A pump 15 is arranged in the first cooling circuit 14 for pumping a coolant to the engine 12.

The cooling system 11 further comprises a second cooling circuit 16 for increased cooling of the engine 12 and for cooling the vehicle hydraulic components 4,5, 8,9, 10.

The cooling system 11 comprises a radiator 22 arranged in the second cooling circuit 16 for increased cooling of the engine 12. A hydraulic motor 26 is connected to the hydraulic circuit 18 and designed to drive a fan in order to produce an air flow through the radiator 22.

A first heat-exchanger 27 is arranged in the second circuit 16 for an exchange of heat between the hydraulic oil in a first hydraulic circuit 18, which is in turn coupled to the hydraulic components (not shown in FIG. 2), and the coolant in the second cooling circuit 16.

Cooling of the engine and the hydraulic components is therefore integrated into a single system, with a single pump.

The cooling system 11 comprises a second heat-exchanger 28, which is integrated with the first heat exchanger 27 in a single component 17. The second heat exchanger is designed for an exchange of heat between transmission oil in a second hydraulic circuit 19, which is in turn coupled to a transmission component (not shown in FIG. 2), and the coolant in the second cooling circuit 16.

The transmission component may comprise, for example, a part that is intended to rotate, such as a shaft and/or a gear in a gearbox in the vehicle. Alternatively or in addition, the transmission component may comprise a part in one of the vehicle wheel axles. Cooling of the engine, the hydraulic components and the transmission components is therefore integrated in a single system, with a single pump.

The cooling system 11 further comprises means 20 for coupling the second cooling circuit 16 into the first cooling circuit 14 in order to also provide the second cooling circuit with coolant from the pump 15. The coupling means 20 here comprises a thermostat. The thermostat is controlled by the engine temperature, and more specifically by the coolant temperature. The thermostat is designed to cut in, thereby bringing the second cooling circuit 16 into operation when the engine temperature exceeds a certain value.

The cooling system 11 further comprises a line 21 coupled from the first cooling circuit 14 to the second cooling circuit 16 bypassing the thermostat 20 and the engine 12, so that the second cooling circuit is supplied with coolant from the pump via the bypass line 21 even when the thermostat is in the disconnected position. The bypass line 21 is therefore arranged in parallel with the thermostat 20 and the engine 12.

The bypass line 21 is designed for a substantially smaller flow than the first cooling circuit, with the object of ensuring that the second circuit 16 is supplied with a certain quantity of coolant even if the engine temperature does not reach the the value at which the thermostat cuts in. The bypass line 21 is therefore designed for a smaller flow than the main line 16. This means that a greater flow of coolant goes to the second cooling circuit 16 after the thermostat has cut in than before it cuts in. In this way a certain cooling/heating of the the hydraulic and/or transmission components is obtained throughout when in operation.

Besides a working cylinder, the the hydraulic component may also comprise, for example, a hydraulic motor or a hydraulic pump.

The cooling system 11 comprises a further heat-exchanger 23, which can be connected to the first hydraulic circuit 18 for an exchange of heat with air. A means 24 is designed for automatically bringing the further heat exchanger into operation when the hydraulic oil temperature exceeds a specific value. The coupling means 24 comprises a temperature-controlled valve. This coupling means 24 is intended to cut in before the engine thermostat 20 cuts in.

One advantage with the cooling system 11 described above, which is designed for cooling/heating multiple different sub-systems (engine, hydraulics, transmission) is that heat differentials can be utilized in order to cool a specific sub-system or to heat another subsystem.

The coolant ordinarily at least substantially comprises water.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

The invention must not be regarded as being limited to the examples of embodiment described above, a number of further variants and modifications being feasible within the scope of the following patent claims.

What is claimed is:

1. A cooling system for a vehicle, the system comprising:

a first cooling circuit coupled to the vehicle engine for cooling the engine;

a pump arranged in the first cooling circuit for pumping a coolant to the engine;

a second cooling circuit for cooling at least one other component in the vehicle;

means for coupling the second cooling circuit into the first cooling circuit in order to also supply the second cooling circuit with coolant from the pump when the coupling means is in a connected position, a bypass line coupled from the first cooling circuit to the second cooling circuit bypassing the coupling means, so that the second cooling circuit is supplied with coolant from the pump via the bypass line even when the coupling means is in a disconnected position.

2. The cooling system as claimed in claim 1, wherein the bypass line is designed for a substantially smaller flow of coolant than a flow of coolant in the first cooling circuit.

3. The cooling system as claimed in claim 1, wherein the coupling means is operatively controlled in response to engine temperature such that when the engine temperature exceeds a predetermined value the coupling means is brought into operation and connects the second cooling circuit to the first cooling circuit.

4. The cooling system as claimed in claim 1, wherein the system comprises a radiator, which is arranged in the second cooling circuit and is designed for an exchange of heat with air for cooling the coolant.

5. The cooling system as claimed in claim 1, wherein the component comprises a hydraulic component.

6. The cooling system as claimed in claim 5, wherein the hydraulic component comprises a working cylinder.

7. The cooling system as claimed in claim 5, comprising a heat-exchanger arranged in the second cooling circuit for an exchange of heat between hydraulic oil in a hydraulic circuit, the hydraulic circuit being coupled to the hydraulic component, and coolant in the second cooling circuit.

8. The cooling system as claimed in claim 1, wherein the component comprises a transmission component arranged in a vehicle transmission.

9. The cooling system as claimed in claim 8, comprising a heat-exchanger, which is arranged in the second cooling circuit for an exchange of heat between transmission oil in a hydraulic circuit, the hydraulic circuit being coupled to the transmission component, and coolant in the second cooling circuit.

10. The cooling system as claimed in claim 1, wherein the component comprises a hydraulic component and a transmission component arranged in a vehicle transmission, the system comprising a first heat-exchanger arranged in the second cooling circuit for an exchange of heat between hydraulic oil in a first hydraulic circuit, the first hydraulic circuit being coupled to the hydraulic component, and coolant in the second cooling circuit, and comprising a second heat-exchanger, which is arranged in the second cooling circuit for an exchange of heat between transmission oil in a second hydraulic circuit, the second hydraulic circuit being coupled to the transmission component, and coolant in the second cooling circuit, and wherein the first and second heat-exchanger are integrated into a single component.

11. The cooling system as claimed in claim 10, comprising a further heat-exchanger which can be connected to a further hydraulic circuit for an exchange of heat with air, the system comprising means for automatically bringing the further heat exchanger into operation when hydraulic fluid temperature in the further hydraulic circuit exceeds a specific value.

12. The cooling system as claimed in claim 1, comprising a heat-exchanger which can be connected to a hydraulic circuit for an exchange of heat with air, the system comprising means for automatically bringing the heat exchanger into operation when hydraulic fluid temperature in the hydraulic circuit exceeds a specific value.

13. The cooling system as claimed in claim 1, wherein the coupling means comprises a thermostat.

14. A vehicle comprising a cooling system as set forth in claim 1.

15. A cooling system for a vehicle, the system comprising:

a first cooling circuit coupled to the vehicle engine for cooling the engine;

a pump arranged in the first cooling circuit for pumping a coolant to the engine;

a second cooling circuit for cooling at least one other component in the vehicle;

a thermostat for coupling the second cooling circuit into the first cooling circuit in order to also supply the second cooling circuit with coolant from the pump when the coupling means is in a connected position, a bypass line coupled from the first cooling circuit to the second cooling circuit bypassing the thermostat, so that the second cooling circuit is supplied with coolant from the pump via the bypass line even when the thermostat is in a disconnected position.

16. The cooling system as claimed in claim 15, wherein the component comprises a hydraulic component.

17. The cooling system as claimed in claim 16, comprising a heat-exchanger arranged in the second cooling circuit for an exchange of heat between hydraulic oil in a hydraulic circuit, the hydraulic circuit being coupled to the hydraulic component, and coolant in the second cooling circuit.

18. The cooling system as claimed in claim 15, wherein the component comprises a transmission component arranged in a vehicle transmission.

19. The cooling system as claimed in claim 18, comprising a heat-exchanger, which is arranged in the second cooling circuit for an exchange of heat between transmission oil in a hydraulic circuit, the hydraulic circuit being coupled to the transmission component, and coolant in the second cooling circuit.

20. The cooling system as claimed in claim 15, wherein the component comprises a hydraulic component and a transmission component arranged in a vehicle transmission, the system comprising a first heat-exchanger arranged in the second cooling circuit for an exchange of heat between hydraulic oil in a first hydraulic circuit, the first hydraulic circuit being coupled to the hydraulic component, and coolant in the second cooling circuit, and comprising a second heat-exchanger, which is arranged in the second cooling circuit for an exchange of heat between transmission oil in a second hydraulic circuit, the second hydraulic circuit being coupled to the transmission component, and coolant in the second cooling circuit, and wherein the first and second heat-exchanger are integrated into a single component.

* * * * *